US009346083B2

(12) United States Patent
Stone

(10) Patent No.: US 9,346,083 B2
(45) Date of Patent: May 24, 2016

(54) MAIL CARRIER SEQUENCER

(71) Applicant: Robert Louis Stone, Perry Hall, MD (US)

(72) Inventor: Robert Louis Stone, Perry Hall, MD (US)

( * ) Notice: Subject to any disclaimer, the term of this patent is extended or adjusted under 35 U.S.C. 154(b) by 0 days.

(21) Appl. No.: 14/297,740

(22) Filed: Jun. 6, 2014

(65) Prior Publication Data

US 2014/0360926 A1 Dec. 11, 2014

Related U.S. Application Data

(60) Provisional application No. 61/831,840, filed on Jun. 6, 2013.

(51) Int. Cl.

| | |
|---|---|
| ***B07C 3/06*** | (2006.01) |
| ***B07C 3/08*** | (2006.01) |
| ***B07C 5/06*** | (2006.01) |
| *B07C 3/00* | (2006.01) |

(52) U.S. Cl.

CPC ... *B07C 3/06* (2013.01); *B07C 3/08* (2013.01); *B07C 3/082* (2013.01); *B07C 3/087* (2013.01); *B07C 5/06* (2013.01); *B07C 3/008* (2013.01)

(58) Field of Classification Search

CPC ..... B07C 3/00; B07C 3/008; B07C 3/08; B07C 3/02; B07C 3/082; B07C 3/087

USPC ..... 209/900

See application file for complete search history.

(56) References Cited

U.S. PATENT DOCUMENTS

| | | | | |
|---|---|---|---|---|
| 6,523,697 | B1 * | 2/2003 | Malatesta | B07C 3/008 198/367 |
| 7,728,244 | B2 * | 6/2010 | De Leo et al. | 209/583 |
| 7,905,344 | B2 * | 3/2011 | Fritsche et al. | 198/704 |
| 8,485,522 | B2 * | 7/2013 | Schererz | B07C 3/08 271/198 |
| 2009/0060698 | A1 * | 3/2009 | Enenkel | 414/592 |
| 2011/0119414 | A1 * | 5/2011 | Zimmermann | 710/53 |
| 2014/0121826 | A1 * | 5/2014 | Kreitmeier | B07C 3/00 700/223 |

* cited by examiner

*Primary Examiner* — Jeremy R Severson

(74) *Attorney, Agent, or Firm* — Ober, Kaler, Grimes & Shriver; Royal W. Craig

(57) ABSTRACT

A mail sortation system that can process mail, either letter or flat, from random order to delivery point sequence (DPS) order, in a single sortation pass. The system has a first sortation assembly comprising a plurality of individual open-topped receptacles into which mail is received, each receptacle having a trap door for selectively dumping its contents. A second sortation assembly comprises a linearly-translating conveyor positioned beneath the first sortation assembly, and an open topped bin travels along the conveyor to gather mail from the first assembly in a DPS sequence. A third sortation assembly comprises a linearly-translating conveyor arranged parallel to and directly beneath the second sortation assembly, and a plurality of mail bins mounted atop for receiving DPS-sorted batches from the second assembly.

20 Claims, 5 Drawing Sheets

MAIL CARRIER SEQUENCER

CROSS-REFERENCE TO RELATED APPLICATION(S)

The present application derives priority from U.S. Provisional Patent Application Ser. No. 61/831,840 filed 6 Jun. 2013.

BACKGROUND OF THE INVENTION

1. Field of the Invention

The present invention relates generally to mail processing systems and, more particularly, to a system that is intended to process flat-shaped mail including envelopes, newspapers, catalogs, magazines, and other publications that meet U.S. postal service size and flexibility standards, although this invention equally applies to letter or parcel mail of varying shapes and sizes, by sequencing the mail from random order into a specific delivery point sequence (DPS) order.

2. Description of the Background

There are a number of schemes that mailers can use in preparing bundles of flats mail and each scheme has a mailing cost assigned to it by the U.S. Postal Service. Bundles are created to allow flats that are destined for the same carrier route or zone to be processed together. In a 3-digit scheme, all mail within each bundle must be addressed to a delivery point within a postal zone within a zip code having the same first three digits. In a 5-digit scheme, the zip code must have the same first five digits. In a carrier route scheme, the bundle must only contain mail for a specific carrier who delivers the mail. Each bundling scheme is processed by the USPS differently. As mail carriers receive their flats for the day, some of their mail has already been automatically sequenced into "delivery point sequence" (DPS) order, although a large remainder of their mail is in a random order and requires the mail carrier to manually organize them into the sequence of his/her delivery route. The manual DPS process entails placing each piece of mail into a series of receptacles one each corresponding to each delivery point on the carrier's route. The carrier then removes the mail from the receptacles in the order in which the carrier traverses his mail route, thereby creating a bundle of mail pre-sorted in accordance with DPS order. This way when the carrier arrives at each delivery point on their route they need only remove from the "top" of their bundle. Manual DPS casing is time and labor intensive and error prone.

Over the past 30 years, the Postal Service has purchased equipment and developed strategies to automate the processing of flat mail. In 1999, the Postal Service deployed the first fully automated flat sorting machine, the AFSM 100. The AFSM 100 can process more than 16,000 flats per hour but is only capable of a primary sort that separates the mail by its 5-digit ZIP Code. The mail must be transported to an incoming secondary operation for DPS processing.

The USPS contracted with Northrop Grumman and other vendors to design and construct a flats sequencing system (FSS). The purpose of the FSS was to automate the sequencing of flat mail for the purpose of reducing costs, absorbing growth and stabilizing postage rates. The FSS was introduced in 2008 but has been plagued by problems ever since. The FSS uses a dual pass sort technique. The first pass determines the address information, learns how many letters are to be sent to each delivery point, and starts the sorting process. During the second pass, mail from the original output is resequenced according to DPS. The USPS's $1.4 billion investment in FSS was supposed to revolutionize the labor-intensive process of delivering catalogs, magazines, newspapers, and other flat mail, but the system is still plagued by machine downtime, late deliveries, and other problems.

What is needed is a system capable of serving as a standalone sortation system or retrofit to an existing AFSM-100 sorter that can process mail, either letter or flat, in any generally thin form, from random order to sequenced DPS order, in a single sortation pass.

The present application describes a system capable of processing mail, either letter or flat or small parcels, in any generally thin form, that is in random order and to sequence it into a specific order, in this case that is the order of the delivery stop points of the mail delivery carrier. This system is uniquely different than current systems in that it will process this random mail into a sequence order in a single sortation pass.

SUMMARY OF THE INVENTION

It is an object of the invention to provide an improved flats carrier sequencer (FCSR) system to provide a single pass delivery point sequencing (DPS) solution, which can be retrofit to existing sorters, such as the USPS AFSM 100 sort platform within its existing footprint.

It is another object to provide an FCSR that is more economical than conventional two-pass mail sequencers, the single pass ability eliminating staging between the multiple passes, as well as eliminating staging and/or conveyor handling equipment to thereby reduce the size of the system, and eliminate space and cost.

It is still another object to increase the effective sort time (efficiency) by a single pass delivery point sequencing (DPS) solution, more than doubling the throughput of sequenced mail.

It is another object to provide a single pass delivery point sequencing (DPS) solution that eliminates the challenge of returning mail from sorter outputs to the feeder (i.e., tray exchanges, feeder ledge loading, tray staging, etc.).

The present invention is described in greater detail in the detailed description of the invention, and the appended drawings. Additional features and advantages of the invention will be set forth in the description that follows, will be apparent from the description, or may be learned by practicing the invention.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Reference will now be made in detail to preferred embodiments of the present invention, examples of which are illustrated in the accompanying drawings. Wherever possible, the same reference numbers will be used throughout the drawings to refer to the same or like parts. The exemplary embodiment will be described in the context of a system for retrofit to an existing AFSM-100 sorter for sequencing flats mail from random order to sequenced DPS order, in a single sortation pass. To retrofit the single-pass sequencing capability into an existing AFSM-100 platform, it is desirable to recycle existing feeders, readers and sorters already in USPS inventory and avoid their replacement expense.

Figure 1:
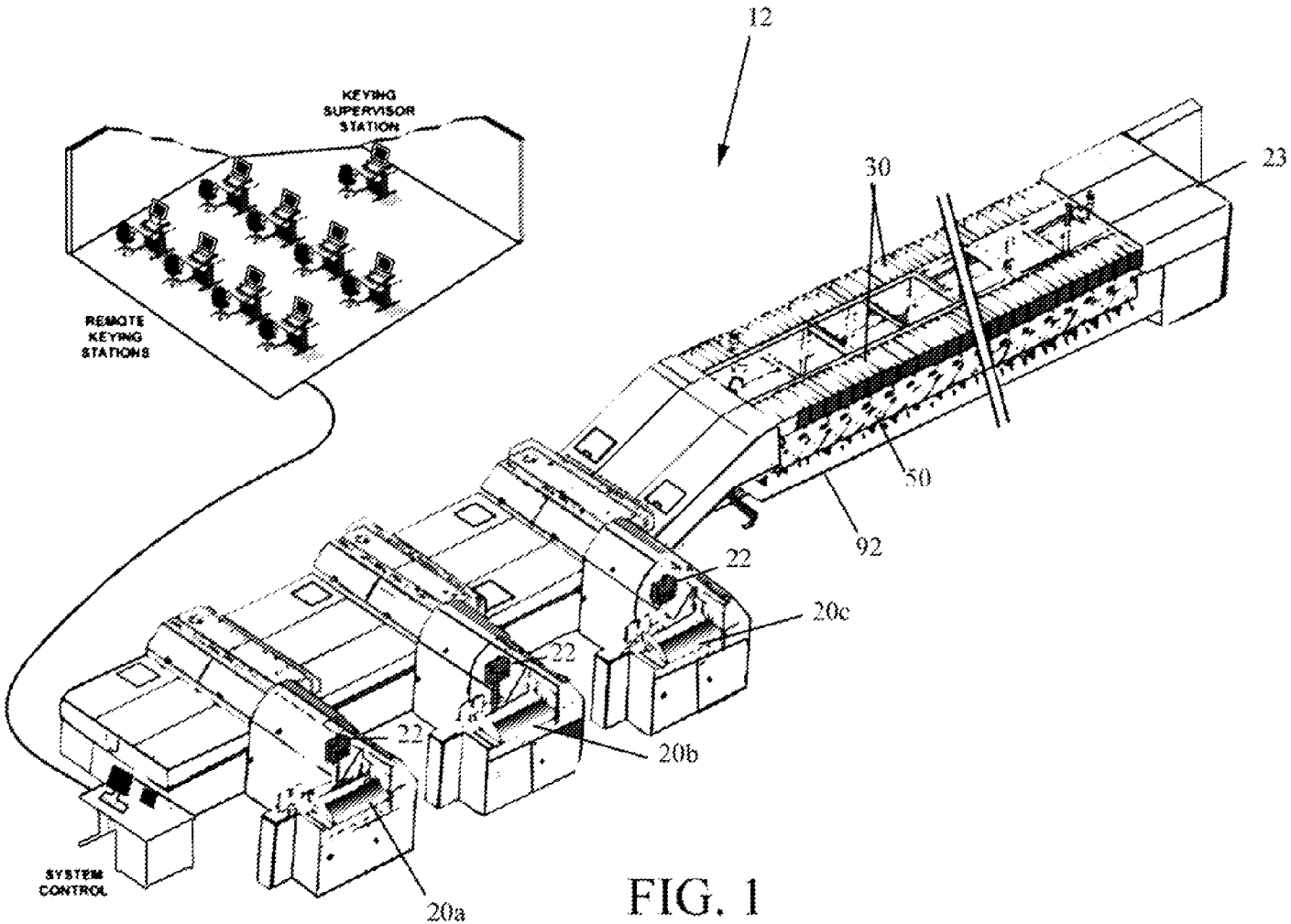
FIG. 1 is perspective view of a USPS ASFM-100 sorter retrofit with the FCSR system 50 according to the present invention.

As shown in FIG. 1, the existing AFSM-100 sortation assembly 12 is a flat-sorting system, such as the type manufactured and marketed by Alcatel Postal Automation Systems, Mannesmann Dematic Postal Automation, Mannesmann Dematic Rapistan Corp., or Siemens Dematic Corp. Sortation assembly 12 sorts mail received at three induct stations 20*a-c*. A Multiline Optical Character Reader (MLOCR) 22 at each induct station 20*a-c* attempts to resolve each incoming address to a full 11 digit zip code during the first pass on the sorting assembly 12. The MLOCR 22 is a known type of mail sorting scanner that uses Optical Character Recognition (OCR) technology to capture images of the front of flats mailpieces, and extracts the entire address from each piece. It looks up the postal code within each address in a master database, prints a barcode representing this information on the mail piece. The sortation assembly 12 uses the 11 digit zip code to send the mail piece to the correct output during the first pass. If DPS sequencing is desired then mail is then fed back through on a second pass to be sorted to the delivery point sequence. The sortation assembly 12 includes a carousel-type sorter which deposits articles into particular chutes 30 for depositing in bin containers 34 positioned under the chutes. After the containers 34 are at least partially filled with articles, a container handling system discharges them to output end 23.

The FCSR system 50 of the present invention is a major sub-assembly that is retrofitted onto the AFSM-100 carousel 30 between chutes 30 and bins 92 (e.g., trays), as shown. This way, the AFSM-100 carousel 30 essentially becomes the mechanism by which mail is fed, read, and delivered into the present FCSR system 50. A key characteristic of the AFSM-100 as it relates to the invention is that the AFSM-100 has 750 carousel slots which transport mail after it is read. With the declines in USPS mail volumes, the typical mail carrier route has reduced from approximately 1000 pieces per route to approximately 400 pieces per route. This logistical change is a fundamental reason that the present FCSR invention is a superior system to the existing FSS, as well as other large traditional two-pass USPS carrier route as the AFSM-100 has enough carousel slots to hold one, and in certain combinations more than one, route of mail. Therefore, this invention uses this fact to allow all the mail of a route to be fed into the AFSM-100 and read, enabling the FCSR to analyze the entire route of mail, then logically and systematically process them mail into DPS.

Figure 2:
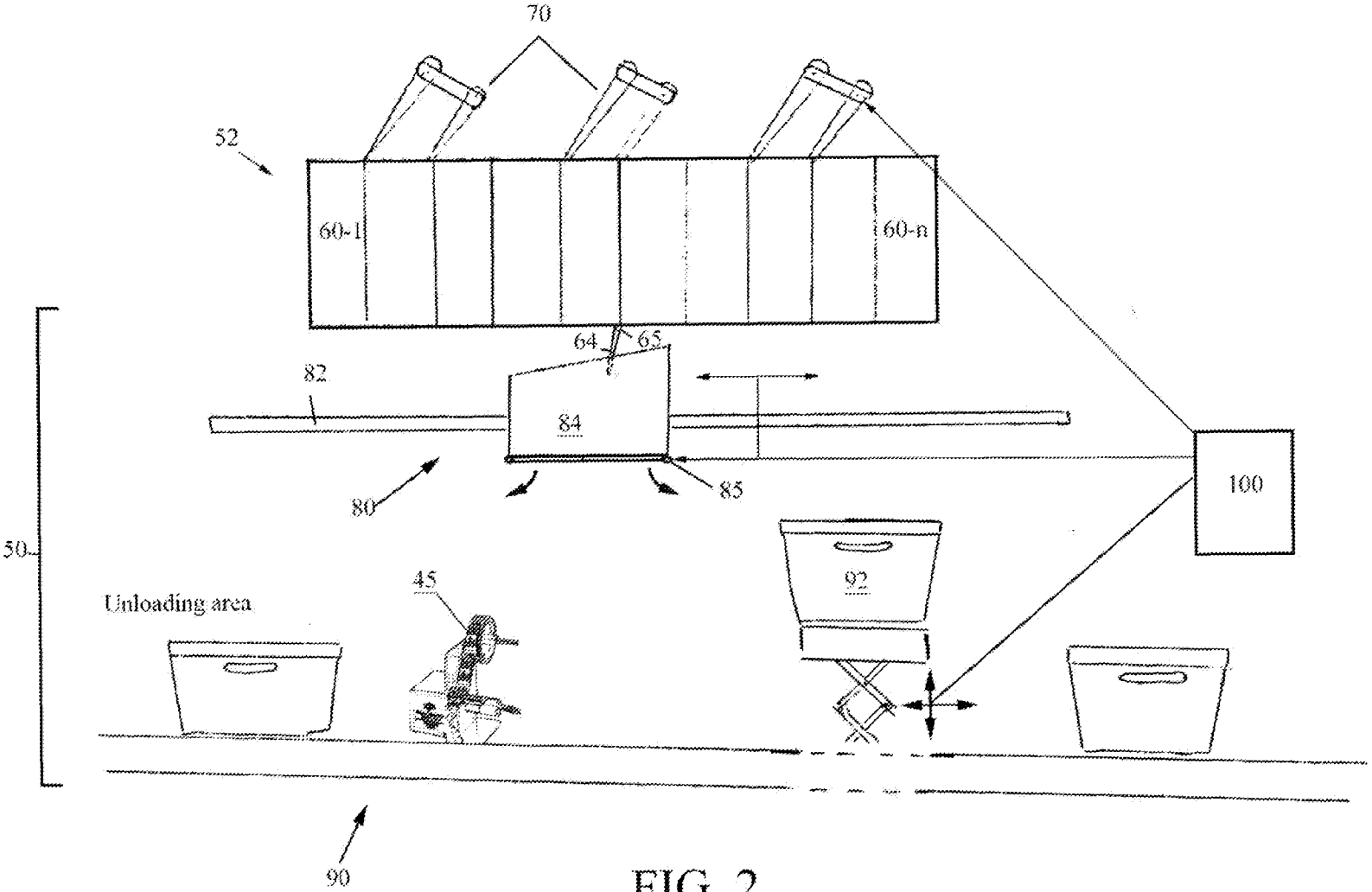
FIG. 2 is a side view of the FCSR system 50 of FIG. 1.

FIG. 2 is a side view of the FCSR system 50 of FIG. 1. The FCSR system 50 generally comprises four major subsystems:

1) A Random-In-Sequenced-Out (RISO) sortation assembly 52 comprising any number of individual RISO receptacles 60-1 . . . *n* into which mail is initially received from chutes 30 of AFSM-100 carousel, via a plurality of overhead gate assemblies 70. Each RISO receptacle 60-1 . . . *n* is also equipped with an underlying trap door 64 (to be described) for dumping the contents of RISO receptacles 60-1 . . . *n*.

2) A linearly translating "BinBot" module 80 located beneath RISO assembly 52 that comprises a first linear conveyor 82 and traveling open-topped bin 84 which rides along the conveyor 82, and which is adapted to traverse the length of all the RISO receptacles 60-1 . . . *n*. The underlying trap door 64 of each receptacle is equipped with an automatic door opening/closing mechanism 65 capable of selectively opening trap door 64 while bin 84 is positioned beneath to allow it to dump its contents of selected RISO receptacles 60-1 . . . into the open-topped receptacle 84 of the BinBot module 80. The opening/closing mechanism 65 may be implemented mechanically by a contact-latch or electromechanically by a motorized mechanism operating under common control with conveyor 82. In both cases a variety of automated door opening/closing mechanisms 65 are known. The bin 84 also has an automatic bottom panel operated by door opening/closing mechanism 85 to allow it to dump its contents into bins 92.

3) A Bin Loader 90, including conventional bins 92 seated atop a second conveyor 97 that leads to an unloading area, and an automatic labeling system 45 to label the bins 92 with a bin number and other information as desired for the particular carrier.

4) A programmable controller 100, with integrated electrical distribution and safety system, in communication with the foregoing components to control operation and DPS-sequence the mail. The controller 100 is also in communication with AFSM-100 sorter 12 for deriving mail sequence data therefrom.

In operation, incoming mail is received into the RISO receptacles 60-1 . . . *n* of RISO assembly 52 from the chutes 30 of AFSM-100 carousel. One skilled in the art will appreciate that incoming mail can be dropped into the receptacles 60-1 . . . *n* in any order.

Once the last piece of mail of a particular grouping has been fed and read by AFSM-100 sorter 12 (FIG. 1), sorter 12 sends all the mail piece data electronically to the FCSR controller 100. The FCSR controller 100 hosts DPS software that determines the sequence order that the mail is required for delivery point sequence (DPS) order. The DPS software module performs this sequencing by cross-referencing the mail to the delivery sequence tables of the customer and calculating the most effective delivery and collection sequences in a known manner.

Given the determined DPS, the FCSR system 50 groups the mail into small subgroups, in the order of the DPS. Each of these sub groups is assigned to a particular RISO receptacle 60-1 . . . *n*. It should be understood that there are multiple RISO receptacles 60-1 . . . *n* per RISO assembly 52, and there may be many RISO assemblies 52. The quantity of RISO receptacles 60-1 . . . *n* per RISO assembly 52, and of RISO assemblies 52 is a matter of design choice.

As the mail is dropped into a compartment of a particular RISO receptacle 60-1 . . . *n*, the FCSR controller 100 keeps track of the mail in each RISO receptacle 60-1 . . . *n*. Because the FCSR controller 100 maintains a data file of all the pieces in the entire group, it is able to determine the next piece in sequence order. Mounted below the RISO assembly 52 is the BinBot assembly 80. The traveling open-topped receptacle 84 of BinBot assembly 80 rides along conveyor 82 in a back-and-forth motion under control of FCSR controller 100. The FCSR controller 100 determines the next mail (next in DPS order), moves BinBot receptacle 84 under the specified RISO receptacle 60-1 . . . *n* where that mail resides, and optically, electronically or mechanically triggers the bottom trap door 64, thereby capturing the mail in BinBot receptacle 84. The receptacle 84 is shaped both in angle and bottom form, to securely hold the mail such that the bindings are organized, the mail is edge aligned, and the stack is managed such that as the bindings build up it doesn't create an unstable stack.

The receptacle 84 of BinBot assembly 80 moves back and forth and slowly fills. When full it will release its mail into a bin 92 on underlying conveyor 90. The bins 92 may optionally be mounted on extensible risers 95 which are presented to the BinBot assembly 80. Risers 95 allow for the mail to be removed from the receptacle 84 of BinBot assembly 80 in a controlled manner and inserted into the bins 92.

After releasing its mail into bin 92 on conveyor 90, the BinBot assembly 80 then returns to gathering another bundle of mail. The tray will then be conveyed to the dispatch area. The FCSR system 50 includes an automatic labeling system 45 to label the bin 92 with a bin number and other information for the particular carrier.

Advantageously, the foregoing FCSR system 50 allows the mail to be in random order in the AFSM-100 carousel, dropped into the RISO assembly 52 in random order, and output from bins 92 in sequential order, thereby creating a "virtually dynamic" bin location for the output destination. Furthermore, FCSR system 50 provides the ability to compress the sequencing algorithms to only those stops receiving mail. In a traditional sequencing system, there is a dedicated "location" for each delivery point, which is a wasted location if that delivery point receives no mail. The daily delivery point fluctuations are compounded by market variability, most recently a decline in flat mail volumes. Converse to traditional sequencing, the FCSR system 50 sequencing is based on actual volume, rather than a full route.

In a traditional sequencing system, the sortation process of the sequencer is dictated by the destination delivery points. In other words, if stops 1, 4, 6, 10 are each receiving a piece of mail, there is a dead location in the sorting system for stops 2, 3, 5, 7, 8, and 9 since they are not receiving any mail that day, thereby creating inefficiencies. However, a unique factor about the FCSR system 50 is that the sortation process is controlled by the actual mail. The combination of the RISO assembly 52 and BinBot assembly 80 effectively compress the sorter plan to the mail of the day, resulting in a much more efficient system and process.

Figure 3:
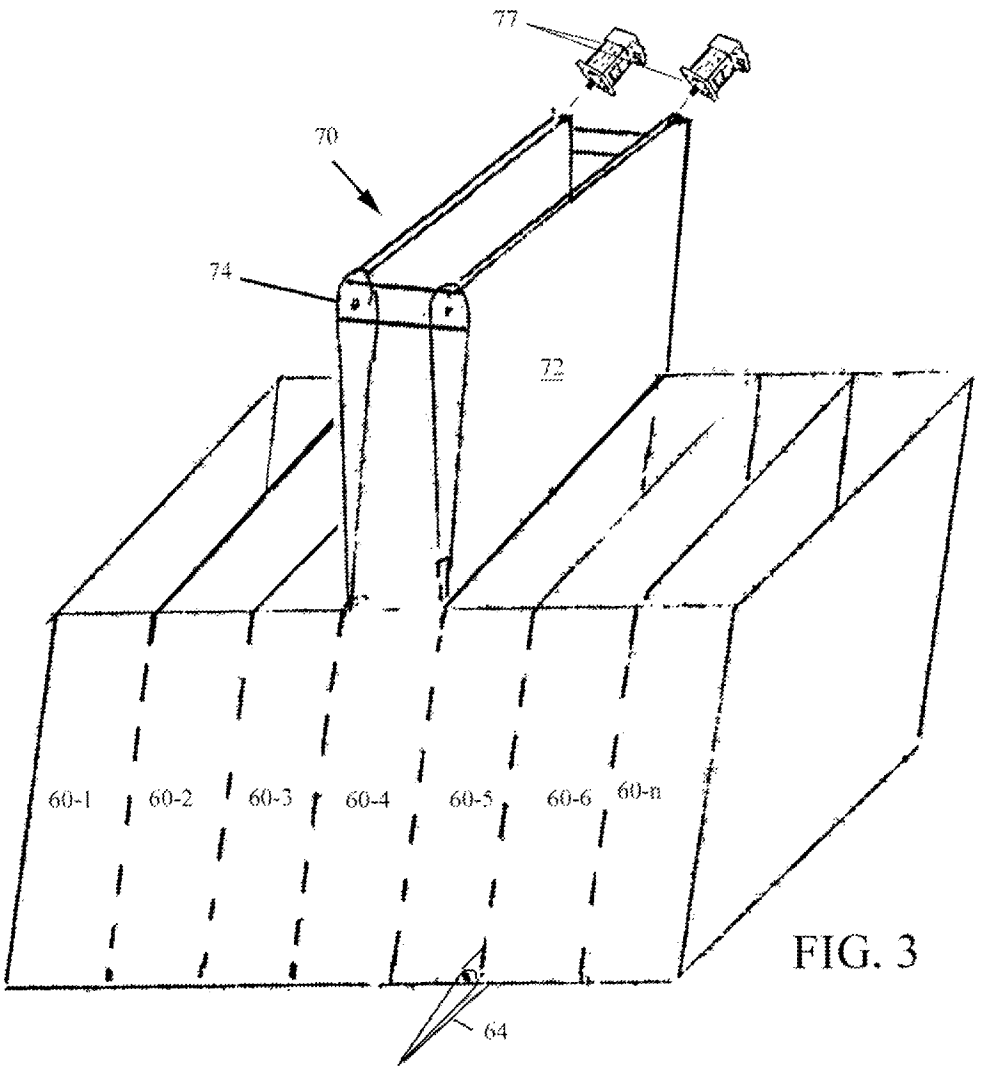
FIG. 3 is an enlarged perspective view of RISO assembly 52 of the FCSR system 50 of FIG. 1.

FIG. 3 is an enlarged perspective view of RISO assembly 52 which may comprise any number of individual RISO receptacles 60-1 . . . *n*. The RISO is a series of collection locations that can be any size specific to the size of the mail intended to be processed. Each RISO receptacle 60 comprises a four-walled narrow enclosure, receptacles 60-1 . . . *n* being interleaved together side-by-side such that minimal space is necessary. Each RISO receptacle 60 may hold either a single piece of mail or multiple mail pieces all with the same destination point and sequence number (it is not necessary that each RISO receptacle 60 be filled, or filled in any particular order). Mail is received into the RISO receptacles 60-1 . . . *n* from the chutes of the AFSM-100 carousel 30 (see FIG. 1) through a plurality of overhead gate assemblies 70 (one being shown in FIG. 3). The gate assemblies 70 generally comprise a converging pair of guide panels 72 connected at each end by a spring-loaded pivot assembly 74 for close-conforming insertion into the elongate open tops of the RISO receptacles 60. The convergent guide panels 72 creates a slightly wider opening than the RISO receptacle 60 to facilitate easier receipt of the mail and to essentially funnel the mail to the multiple RISO receptacles 60-1 . . . *n*. Each gate assembly 70 can pivot at the top such that the bottom moves along an arc toward any number of RISO receptacles 60 as a matter of design choice, determined by variables such as mail piece size. The gate assemblies 70 are automatically actuated by servo motors 77 around their pivot point at their top, which servo motors 77 are in communication with FCSR system controller 100. The illustrated gate assemblies 70 may be translated left or right to direct mail into any of three RISO receptacles 60-3 . . . 5. As an alternative to servo motors 77 any suitable actuators may be used, capable of locating the gate assembly 70 to each of three positions (left, center, right). For example, actuator may be a linear pneumatic actuator, or alternatively can be an AC or DC solenoid, motorized linear actuator, or other suitable device. By positioning the gate assembly 70 at one of the three positions (left, center, right), the gate assembly serves to guide and index the mail from the AFSM-100 carousel 30 into the proper receptacle 60-1 . . . *n*. The shape of the gate assemblies 70 and the tops of the compartments 60-1 . . . *n* may be matched to reflect the arc of the rotation between the three positions (left, center, right) so that no catch points are created. Each RISO receptacle 60-1 . . . *n* is also equipped with an underlying trap door 64 for dumping the contents of RISO receptacles 60-1 . . . *n* into the BinBot assembly 80 below, and the underlying trap door 64 of each receptacle is equipped with an automatic door opening/closing mechanism 65. The illustrated door opening/closing mechanisms 65 may be motorized, or may be purely mechanical and actuated directly by contact with the underlying BinBot assembly 80 for releasing mail down and out of the respective RISO receptacle 60. In the latter instance trap door 64 may be a hinged shutter, hinged to one side of the respective RISO receptacle 60, spring-biased to a closed position, but selectively openable from beneath by the BinBot assembly 80. As the BinBot 80 is positioned below the desired RISO receptacle 60 location, the BinBot assembly 80 catches the trap door 64 and moves it to its open position. When the mail piece passes out of the RISO receptacle 60, the BinBot assembly moves and releases the trap door 64, which springs to the closed position. Alternatively, each trap door 64 may employ a solenoid or servo motor in communication with system controller 100 for release of mail, in which case the servo/solenoid is actuated to move to rotate the trap door 64 between open and closed positions.

In operation, the RISO assembly 52 transfers the mail to the BinBot assembly 80 in DPS order.

Figure 4:
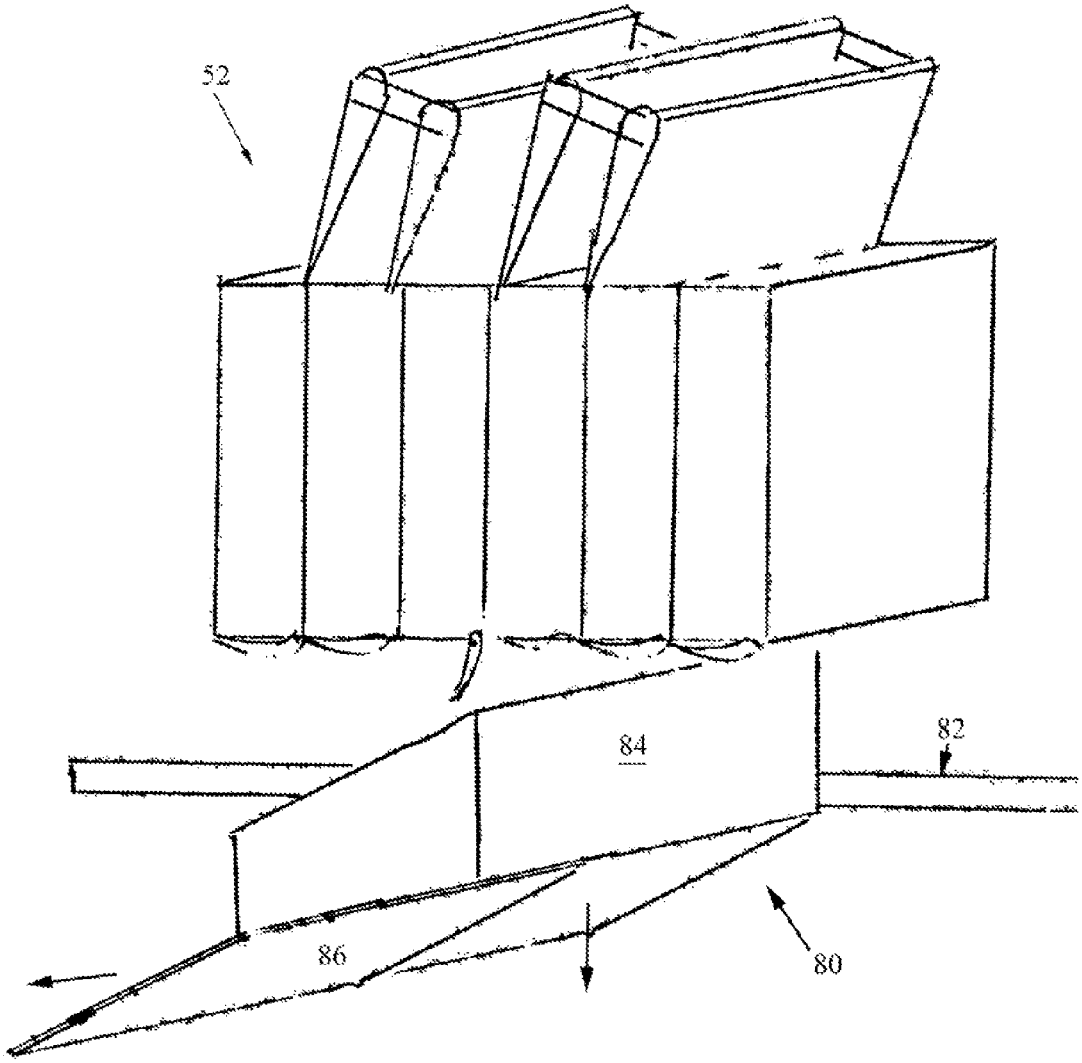
FIG. 4 is an enlarged view of the BinBot assembly 80 of the FCSR system 50 FCSR system 50 of FIG. 1.

As seen in FIG. 4, the BinBot assembly 80 is an independent linear shuttle that accepts the sequenced mail from the RISO assembly 52 and delivers it into a bin 92 (or tray) (see FIG. 2) for dispatch. The BinBot assembly 80 generally comprises a four-walled open-topped receptacle 84 of rectangular shape and appropriate size to maintain the mail stack in an organized shape. The BinBot receptacle 84 is likewise be equipped with an automatic door opening/closing mechanism, in this case preferably a sliding bottom shutter 86 to serve as a trap door for release of the mail. The BinBot receptacle 84 is mounted on a linear conveyor 82 capable of moving axially in two directions to thereby retrieve the mail from the proper RISO receptacle 60, and to unload the mail into a delivery tray/bin 92. Both the first conveyor 82 and second conveyor 90 may be any suitable servo-driven worm gear, belt drive, or other linear conveyor suitable for linear transport. For conveyor 82 a servo-driven linear conveyor is preferred so that the servo encoder readings may be used to determine the exact position of BinBot receptacle 84. In operation, the BinBot receptacle 84 will collect mail from selected RISO receptacles 60 until it has an amount needed to fill a bin 92 or tray, at which time the sliding bottom shutter 86 is opened and mail falls vertically into the bin/tray 92. The sliding bottom shutter 86 may be controlled by a pneumatic actuator that slides the bottom panel between open and closed positions. This way, the mail is maintained in a proper stack position during transition, the mail binding edge of the flats mail touching the four walls. If desired, the BinBot receptacle 84 may be angled downward to employ gravitational pull to keep the mail indexed, until the sliding bottom shutter 86 is slid open.

Figure 5:
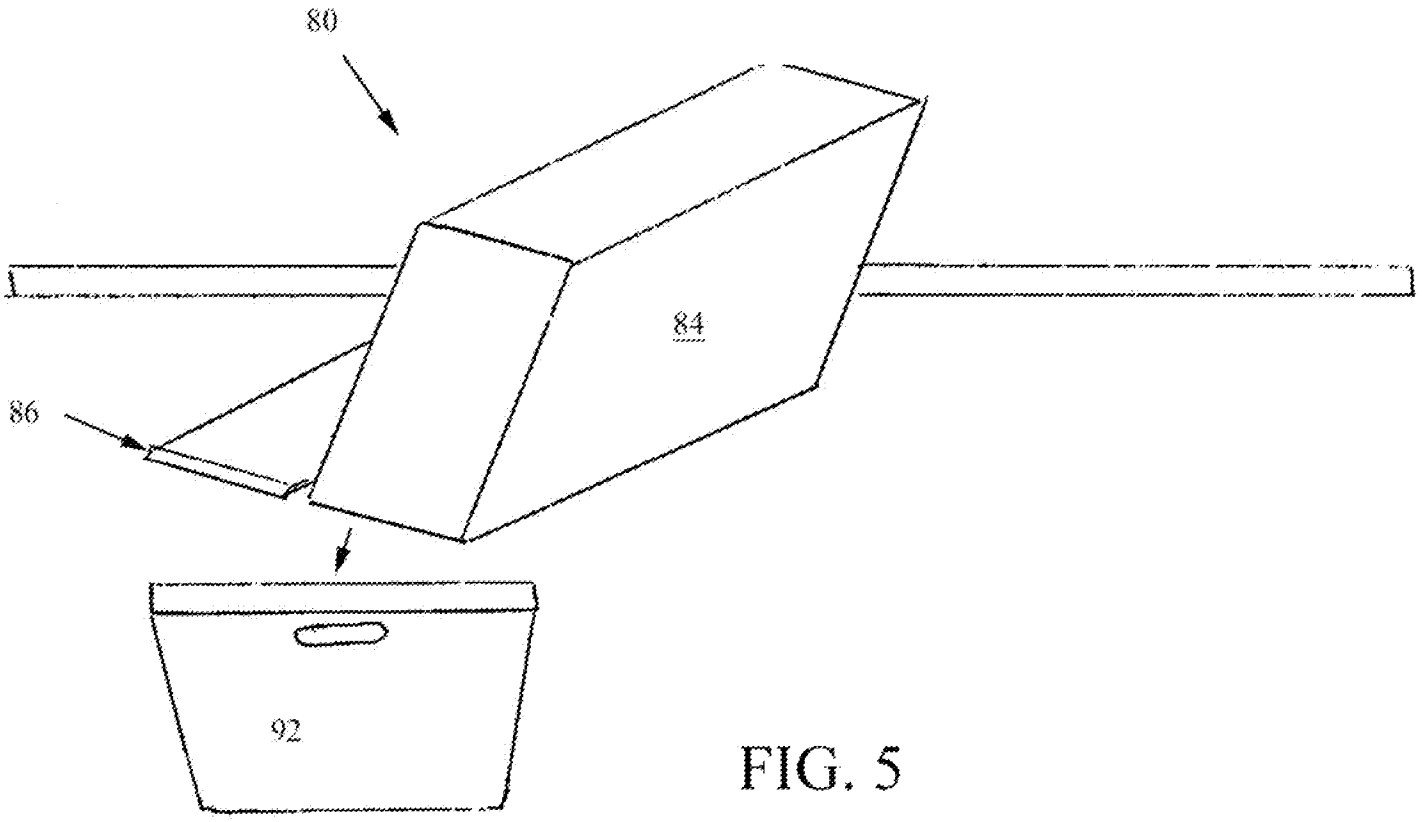
FIG. 5 is a side view illustrating the sliding bottom shutter 86 of BinBot receptacle 84.

FIG. 5 is a side view illustrating the sliding bottom shutter 86 of BinBot receptacle 84 being slid open to transfer mail from the BinBot receptacle 84 into a delivery bin/tray 92.

It should now be apparent that the above described system serves as a standalone or retrofit to an existing AFSM-100 or other sorter serves as a DPS-sequencing solution that can process mail, either letter or flat, in any generally thin form, from random order to sequenced DPS order, in a single sortation pass.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

What is claimed is:

1. A delivery point sequence (DPS) mail sortation system, comprising:

a first sortation assembly comprising a plurality of overhead gate assemblies, each gate assembly comprising a pair of downwardly-inclined controllably-pivotable guide panels defining a chute for directing mail downward at a selectable angle;

a second sortation assembly positioned beneath said first sortation assembly and comprising a plurality of individual stationary open-topped receptacles into which mail is received, each said open-topped receptacle comprising an underlying door for selectively dumping its contents;

a third sortation assembly comprising a linearly-translating conveyor positioned beneath said second sortation assembly and an open topped bin and configured for bi-directional travel along said conveyor for selective positioning beneath any one of said plurality of individual open-topped receptacles, each said open-topped bin comprising an underlying door for selectively dumping its contents;

a fourth sortation assembly comprising a linearly-translating conveyor arranged parallel to and directly beneath the conveyor of said third sortation assembly, and a plurality of mail bins mounted atop the conveyor of said fourth sortation assembly; and a programmable controller in communication with said first, second, third and fourth sortation assemblies, said programmable controller having non-transitory computer memory, and software comprising computer instructions stored on said non-transitory computer memory for intake of mail pieces to said first sortation assembly in random order, and for placing said mail pieces in a sequenced order at said fourth sortation assembly.

2. The DPS mail sortation system according to claim 1, wherein the underlying trap door of each of said individual receptacles of the second sortation assembly includes an automatic opening/closing mechanism in communication with said programmable controller.

3. The DPS mail sortation system according to claim 1, wherein the underlying trap door of each of said individual receptacles of the second sortation assembly includes an automatic opening/closing mechanism operative upon contact with an open topped bin traveling along the conveyor of said third sortation assembly.

4. The DPS mail sortation system according to claim 1, wherein said fourth sortation assembly comprises an automatic labeler positioned along said linearly-translating conveyor.

5. The DPS mail sortation system according to claim 1, further comprising a plurality of extensile stands, each mail bin on the conveyor of said fourth sortation assembly being carried by a corresponding extensile stand for elevating said mail bin on said conveyor.

6. The DPS mail sortation system according to claim 1, wherein the door of said second sortation assembly comprises a pivoting trap door.

7. The DPS mail sortation system according to claim 6, wherein said pivoting trap door is servo-operated under control of said programmable controller.

8. The DPS mail sortation system according to claim 1, wherein the door of said third sortation assembly comprises a sliding shutter.

9. The DPS mail sortation system according to claim 8, wherein said sliding shutter is servo-operated under control of said programmable controller.

10. A delivery point sequence (DPS) mail sortation system, comprising:

a first sortation assembly comprising a plurality of overhead gate assemblies, each gate assembly comprising a pair of downwardly-inclined controllably-pivotable guide panels defining a chute for directing mail downward at a selectable angle;

a second sortation assembly positioned beneath said first sortation assembly and comprising a plurality of stationary individual open-topped receptacles into which mail is received, and a discharge;

a third sortation assembly comprising a linearly-translating conveyor positioned beneath said second sortation assembly and an open topped bin traveling along said conveyor, said open-topped bin having a discharge;

a fourth sortation assembly comprising a linearly-translating conveyor arranged parallel to and directly beneath the conveyor of said third sortation assembly, and a plurality of mail bins mounted atop the conveyor of said fourth sortation assembly; and a programmable controller in communication with said first, second, third and fourth sortation assemblies, said programmable controller having non-transitory computer memory, and software comprising computer instructions stored on said non-transitory computer memory for intake of mail pieces to said first sortation assembly in random order, and for placing said mail pieces in a sequenced order at said fourth sortation assembly.

11. The DPS mail sortation system according to claim 10, wherein each discharge of said open-topped bins of the second sortation assembly comprises a trap door.

12. The DPS mail sortation system according to claim 11, wherein said trap door comprises a motorized automatic opening/closing mechanism in communication with said programmable controller.

13. The DPS mail sortation system according to claim 12, wherein said fourth sortation assembly comprises an automatic labeler positioned along said linearly-translating conveyor.

14. The DPS mail sortation system according to claim 11, wherein said trap door comprises an automatic opening/closing mechanism operative upon contact with an open topped bin traveling along the conveyor of said third sortation assembly.

15. The DPS mail sortation system according to claim 11, wherein said pivoting trap door is servo-operated under control of said programmable controller.

16. The DPS mail sortation system according to claim 10, wherein each discharge of said bin of the third sortation assembly comprises a sliding shutter.

17. The DPS mail sortation system according to claim 16, wherein said sliding shutter is servo-operated under control of said programmable controller.

18. The DPS mail sortation system according to claim 10, further comprising a plurality of extensile stands, each mail bin on the conveyor of said third sortation assembly being carded by a corresponding extensile stand for elevating said mail bin on said conveyor.

19. A method for sorting mail, comprising the steps of:

scanning every mail piece within an unsorted group of mail pieces and storing its corresponding delivery point;

directing said unsorted group of mail into one of a plurality of receptacles based on said delivery point by feeding it through a pair of downwardly-inclined guide panels selectively pivoting toward said one individual open-topped receptacles and recording said receptacle;

calculating a delivery point sequence for said unsorted group of mail pieces;

determining a first sortation order for release of said unsorted group of mail from said plurality of receptacles for initial sequencing;

selectively retrieving said unsorted group of mail piece-by-piece from said plurality of receptacles in said first sortation order to produce a presorted batch of mail; and dumping the presorted batch of mail into a mail bin.

20. The method for sorting mail according to claim 19, comprising a step of conveying said mail bin to an unloading area.

* * * * *